United States Patent [19]

Landt

[11] Patent Number: 4,782,345

[45] Date of Patent: Nov. 1, 1988

[54] TRANSPONDER ANTENNA

[75] Inventor: Jeremy A. Landt, Los Alamos, N. Mex.

[73] Assignee: Amtech Corporation, Santa Fe, N. Mex.

[21] Appl. No.: 891,226

[22] Filed: Jul. 29, 1986

[51] Int. Cl.[4] ..... H01Q 5/00; H01Q 1/40

[52] U.S. Cl. ..... 343/727; 343/700 MS; 343/725; 343/893

[58] Field of Search ..... 343/700 MS, 701, 725, 343/727, 873, 893; 340/570, 572

[56] References Cited

U.S. PATENT DOCUMENTS 4,658,263 4/1987 Urbanski ..... 340/572

FOREIGN PATENT DOCUMENTS 0207020 12/1986 European Pat. Off. ..... 340/572

*Primary Examiner*—William L. Sikes
*Assistant Examiner*—Doris J. Johnson
*Attorney, Agent, or Firm*—Ellsworth R. Roston; Charles H. Schwartz

[57] ABSTRACT

A dielectric member may be thin and planar and may have first and second opposite surfaces. An electrically conductive material is disposed on the first surface at one end of the first surface and an electrically conductive material is disposed on the second surface at the opposite end of the second surface. The conductive materials in the first and second surfaces define a first antenna operative at a first frequency. Slots are provided in the conductive material in the first surface. The slots define a second antenna operative at a second frequency greater than the first frequency. The slots include first and second slots extending in a direction transverse to the relative direction of the conductive materials on the first and second surfaces. The first and second slots may have substantially equal lengths and may be aligned with each other. The slots also include third and fourth slots extending in such relative direction and respectively communicating with the first and second slots. The third and fourth slots are in spaced and parallel relationship to define a conductive portion. The lengths of the first and second slots define the frequency of the signals from the second antenna and the lengths of the third and fourth slots define the impedance of the second antenna. Additional conductive material is disposed on the first surface of the dielectric member in electrical communication with the conductive portion. The additional conductive material is disposed opposite the conductive material on the second surface and is provided with a length defining the impedance of the first antenna.

16 Claims, 1 Drawing Sheet

TRANSPONDER ANTENNA

BACKGROUND OF THE INVENTION

Field of the Invention

This invention relates to antennas and more particularly relates to antennas operative at two (2) widely separated frequencies. The antenna of this invention is particularly adapted to be used in a transponder which constitutes a tag attached to an object to identify the object by transmitting to a reader signals identifying the object.

As commerce becomes increasingly complex, the volume of products requiring individual identifications increases. For example, containers holding goods are stacked on merchant ships. When the merchant ships reach a destination port, only individual ones of such containers have to be unloaded and the remaining containers may be retained on the merchant ship until subsequent destination ports are reached. It would be desirable to identify, on a remote basis such as in the order of thirty (30) to forty (40) feet, the containers which have to be unloaded at the destination port. By identifying such containers on a remote basis, any need for merchant seamen or longshoremen at the destination port to have to inspect such containers individually may be eliminated.

Systems have been developed for identifying an object on a remote basis. Such systems include a reader displaced from the object for interrogating a transponder at the object. The transponder has an identifying code which is individual to the object being interrogated. This code is represented by a sequence of binary 13 s and binary 0's in a pattern individual to the object. Each of the binary 1's and binary 0's in this sequence is converted to a plurality of signals which are transmitted to the reader. The signals in each plurality may have first and second frequencies in a particular pattern to identify a binary "1" and may have first and second frequencies in another pattern to identify a binary "0".

The transponder has an antenna (or antennas) for transmitting the identifying signals to the reader. A problem exists in the transponder with respect to the antenna because the signals are transmitted at different frequencies in different parts of the world in accordance with Governmental standards adopted in such different parts of the world. For example, the transmitting frequency adopted by Government regulations in the United States, Europe and Hong Kong has been approximately nine hundred and fifteen megahertz (915 MHz). The transmitting frequency adopted by Government regulations in the Far East (except for Hong Kong) has been approximately twenty four hundred and fifty megahertz (2450 MHz).

A considerable effort has been made, and a significant amount of money has been expended, to provide a single transmitting assembly, including a single antenna, which is able to receive and transmit signals at each of the two (2) frequencies specified in the previous paragraph. In spite of such effort and such money expenditure, a satisfactory antenna assembly has not been provided to the present time to meet the above requirements.

This invention provides a transmitter assembly which is useful in a transponder to receive and transmit signals at a first frequency such as approximately nine hundred and fifteen megahertz (915 MHz) and at a second frequency such as approximately twenty four hundred and fifty megahertz (2450 MHz). The transmitter assembly includes a single antenna assembly defining two (2) antennas each disposed on a single dielectric member and each operative at an individual one of the frequencies. Each of the antennas is effective in receiving and transmitting signals at its individual frequency.

In one embodiment of the invention, a dielectric member may be thin and planar and may have first and second opposite surfaces. An electrically conductive material is disposed on the first surface at one end of the first surface and an electrically conductive material is disposed on the second surface at the opposite end of the second surface. The conductive materials in the first and second surfaces define a first antenna operative at a first frequency such as nine hundred and fifteen megahertz (915 MHz).

Slots are provided in the conductive material in the first surface. The slots define a second antenna operative at a second frequency greater than the first frequency. This second frequency may be twenty four hundred and fifty megahertz (2450 MHz). The slots include first and second slots extending in a direction transverse to the relative direction of the conductive materials on the first and second surfaces. The first and second slots may have substantially equal lengths and may be aligned with each other. The slots also include third and fourth slots extending in such relative direction. The lengths of the first and second slots define the frequency of the signals from the second antenna and the lengths of the third and fourth slots define the impedance of the second antenna. The third and fourth slots are disposed in a spaced and parallel relationship to define a conductive portion.

Additional conductive material is disposed on the first surface of the dielectric member in electrical communication with the conductive portion on the first surface. The additional conductive material is disposed opposite the conductive material on the second surface and is provided with a length defining the impedance of the first antenna.

Figure 1:
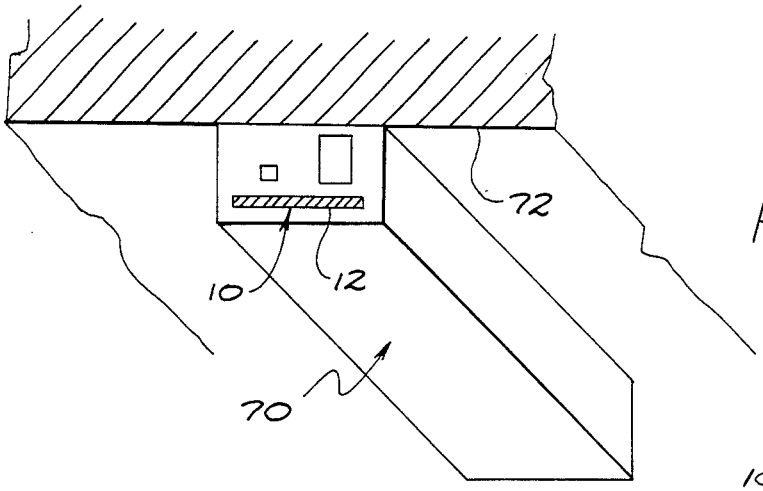
FIG. 1 illustrates an object to be identified and also illustrates a transponder attached to the object to transmit signals for identifying the object and further illustrates an antenna assembly in the transponder for transmitting such identifying signals.
Figure 2:
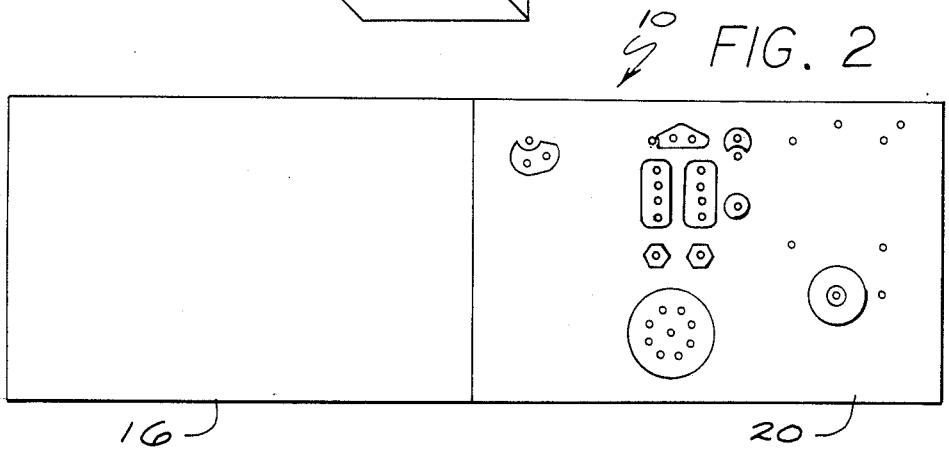
FIG. 2 is a top plan view illustrating the conductive pattern on a first side of a dielectric member included in the antenna assembly.
Figure 3:
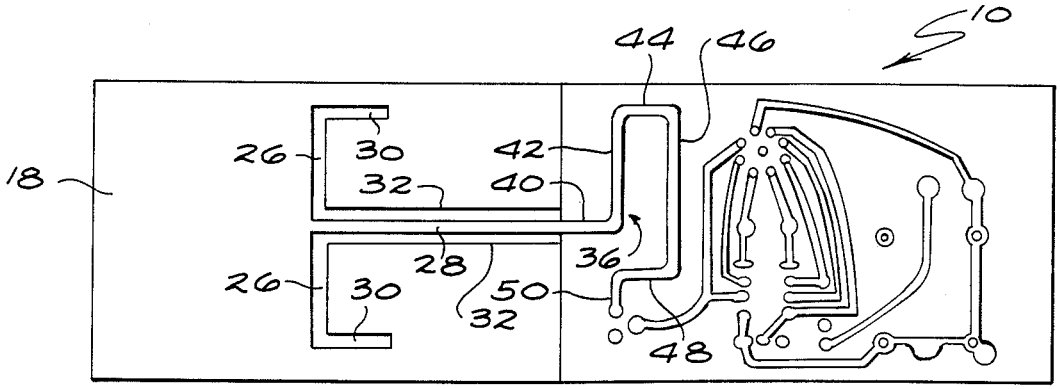
FIG. 3 is a bottom plan view illustrating the conductive pattern on the second side of the dielectric member included in the antenna assembly.

In one embodiment of the invention, an antenna assembly generally indicated at 10 includes a dielectric member 12. The dielectric member 12 may be made from a suitable material such as fiberglass and may be provided with a relatively small thickness such as in the order of one sixteenth of an inch (1/16"). The dielectric member may be provided with oppositely disposed parallel surfaces 14 and 16. The dielectric member 12 may have a suitable length such as approximately six and one half inches (6½") and a suitable width such as approximately two inches (2").

A conductive material 18 may be disposed on the first surface 14 of the dielectric member 12. The conductive material 18 may be made from a thin sheet of a suitable material such as copper and this thin sheet may be covered with a suitable material such as a nickel solder. The conductive material 18 may cover approximately one half (½) of the area of the first surface 14. Similarly, a conductive material 20 may cover approximately one half (½) of the area of the second surface 16. In other words, each of the conductive materials 18 and 20 may have a suitable length such as approximately three and one quarter inches (3¼") and a suitable width such as approximately two inches (2"). The conductive material 20 is at the opposite end of the dielectric member 12 from the dielectric member 18. The conductive materials 18 and 20 define a dipole antenna generally indicated at 22 in FIG. 4. This dipole antenna preferably has a suitable frequency such as in the order of nine hundred and fifteen megahertz (915 MHz).

Slots 26 are provided in the conductive material 18. The slots 26 extend in a direction transverse to the relative direction of the conductive materials 18 and 20. Each of the slots 26 may have a suitable length such as approximately three quarters of an inch (¾") and a suitable width such as approximately three thirty seconds of an inch (3/32"). The slots 26 are substantially aligned with each other. The slots 26 are separated from each other by a conductive portion 28 having a suitable width such as approximately one sixteenth of an inch ("1/16").

At their ends, each of the slots 26 has an extension 30 which extends in the relative direction of the conductive materials 18 and 20. Each of the slots 30 may have a suitable length such as approximately one half of an inch (½") and a suitable width such as approximately three thirty seconds an inch (3/32"). The slots 26 and the extensions 30 define a second antenna having a suitable frequency such as approximately twenty four hundred and fifty megahertz (2450 MHz). The lengths of the slots 26 help to define the frequency of approximately twenty four hundred and fifty megahertz (2450 MHz) and the lengths of the slots 32 define the impedance of this antenna.

The conductive portion 28 extends for a suitable distance such as approximately one and five eighth inches (1⅜") in the relative direction of the conductive materials 18 and 20 and has a width of approximately three sixteenths of an inch (3/16"). The end of the conductive portion 28 coincides substantially with the end of the conductive material 18 on the surface 14. The conductive portion 28 is defined by slots 32 each having a length of approximately one and one half inches (1½") and a width of approximately one eight of an inch (⅛"). The dimensions of the conductive portion 28 define the impedance of the second antenna.

Additional conductive material generally indicated at 36 extends from the conductive portion 28 along the first surface 14 of the dielectric member 12. The additional conductive material 36 is disposed on the half of the first surface 14 where none of the conductive material 18 is disposed. As a result, the additional conductive material 36 is disposed directly opposite the conductive material 20 on the second surface 16. The additional conductive material 36 preferably has a looped configuration defined by portions 40, 42, 44, 46, 48 and 50. These portions have widths of approximately one eighth of an inch (⅛") and respectively have lengths of approximately three eights of an inch (⅜"), three quarters of an inch (¾"), three eights of an inch (⅜"), one inch (1"), three eights of an inch (⅜") and one quarter of an inch (¼"). The dimensions of the portions 40, 42, 44, 46, 48 and 50 define the impedance of the first antenna formed by the conductive materials 18 and 20.

Figure 4:
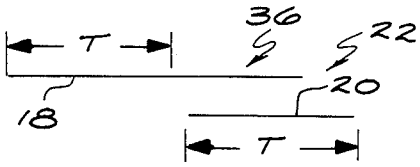
FIG. 4 is a simplified electrical diagram of a first antenna included in the antenna assembly.
Figure 5:
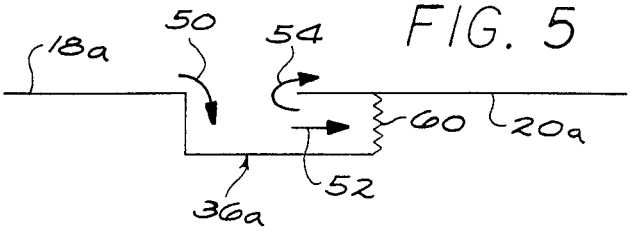
FIG. 5 is a simplified electrical diagram further illustrating the operation of the first antenna in the antenna assembly.

FIG. 4 illustrates on a schematic basis the dipole formed by the conductive materials 18 and 20. As will be seen, the additional conductive material 36 is shown as extending on the first surface 18 over a portion of the conductive material 20 on the second surface 20. FIG. 5 illustrates an equivalent arrangement which would be formed if the conductive materials 18 and 20 were in the same plane, as illustrated at **18*a* and 20*a*. Under such circumstances, the additional conductive material 36 would be in a different plane as indicated at 36*a*. The current flow would then be in a direction as indicated by arrows 50, 52 and 54 in FIG. 5. A load 60 would then be considered as being connected between the conductive material 20*a* and the additional conductive material 36*a***.

As will be seen, the formation of the slots 26 in the conductive material 18 tends to limit the magnitudes of the currents provided in the dipole antenna which is defined by the conductive materials 18 and 20. However, even with this limitation in the magnitude of the current, the antenna defined by the conductive materials 18 and 20 is able to provide a relatively large magnitude of current. This limitation in current is offset, however, by the advantage of having a second antenna on the dielectric member 12.

The provision of two antennas in the antenna assembly 10 is advantageous because different frequencies are used in transponders throughout the world. A frequency of approximately nine hundred and fifteen megahertz (915 MHz) is used in the United States, Europe and Hong Kong. A frequency of twenty four hundred and fifty megahertz (2450 MHz) is used in the Far East except for Hong Kong. By providing on the antenna assembly 10 two antennas each having one of the above frequencies, the antenna assembly 10 can accordingly be used throughout the world. Of course, as will be appreciated, the antenna operating at the frequency of nine hundred and fifteen megahertz (915 MHz) will preferably be used unless Government regulations prevent this since it provides a greater range of operation than the antenna operating at the frequency of twenty four hundred and fifty megahertz (2450 MHz).

The antenna defined by the conductive portions 18 and 20 provides high voltages at the centers of the surfaces 14 and 16. The voltage in this antenna decreases toward the periphery of the conductive materials 18 and 20 in the lengthwise direction. Similarly, the antenna at the high frequency provides a high voltage at the center positions of the slots 26 and provides a decreasing voltage towards the periphery of the slots.

The antenna assembly 10 may be included in a transponder generally indicated at 70 in FIG. 1. The transponder 70 may be constructed as disclosed fully and claimed in co-pending application Ser. No. 885,250 filed on July 14, 1986, in the name of Alfred R. Koelle and assigned of record to the assignee of record of this application. The transponder 70 may be attached to an object 72 to transmit to a reader (not shown) pluralities of signal cycles in an individual code identifying the object. This code may be identified by individual combinations of signal cycles at first and second frequencies such as twenty kilohertz (20 KHz) and forty kilohertz (40 KHz). The reader may be constructed as disclosed fully and claimed in co-pending application Ser. No. 885,250 filed on July 14, 1986, in the names of Alfred R. Koelle and Jeremy A. Landt as joint inventors and assigned of record to the assignee of record of this application.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination, a thin planar dielectric member, first conductive material on a first portion of one surface of the planar member, second conductive material on a second portion of the other surface of the planar to define with the first conductive material a first antenna operative at first frequencies, the second portion being displaced from the first portion in a first direction along the planar surfaces of the dielectric member, and slots included in the first conductive material to define a conductive portion which extends from the first portion to a position of the first planar surface opposite to the second portion on the second planar surface and which defines a second antenna operative at second frequencies higher than the first frequencies.

2. In a combination as set forth in claim 1, the first conductive material occupying substantially one half of the area of the first surface on the dielectric member, and the second conductive material occupying substantially the other half of the second surface on the dielectric member.

3. In a combination as set forth in claim 2, the slots having portions disposed in the conductive material on the first surface in a second direction transverse to the first direction.

4. In a combination as set forth in claim 3, the slots defining a conductive portion extending in the first direction, additional conductive material extending from such conductive portion in the first and second directions on the first planar surface opposite the second conductive material to define the impedance of the first antenna.

5. In combination, a thin dielectric member having first and second oppositely disposed planar surfaces, an electrically conductive material on the first planar surface of the dielectric member at a first end of the first surface, an electrically conductive material on the second planar surface of the dielectric member at a second end of the second surface, the second end being opposite to the first end in a first direction along the planar surface, the first and second conductive materials defining a first antenna operative at a first frequency, and spaced slots in the conductive material on the first planar surface to produce a conductive portion first defines a second antenna operative at a second frequency higher than the first frequency.

6. In a combination as set forth in claim 5, additional conductive material on the first surface of the planar member at a position opposite the conductive surface on the second planar member, such additional conductive material being disposed in a looped configuration to define a particular impedance for the first antenna.

7. In a combination as set forth in claim 5, the spaced slots including first slot portions extending in the first direction and second slot portions communicating with the first slot portions and extending along the first planar surface in a second direction substantially perpendicular to the first direction.

8. In a combination as set forth in claim 7, the second slots respectively extending in the second direction from the first slots to provide a progressively increased spacing between the second slots in accordance with such respective extensions.

9. In a combination as set forth in claim 8, the first slots being disposed in spaced and parallel relationship in the first conductive material to provide the conductive portion between the slots with a length defining the particular impedance for the second antenna, the additional conductive material on the first surface extending from the conductive portion on such first surface.

10. In combination, a thin flat dielectric member having first and second substantially parallel surfaces, conductive material on the first surface of the dielectric member at a first end of the first surface, conductive material on the second surface of the dielectric member at a second end of the second surface to define, with the conductive material on the first surface, an antenna operative at a first frequency, the first and second ends being opposite from each other in a first direction, and slots in the conductive material on the first surface of the dielectric member to define a second antenna operative at a second frequency higher than the first frequency and defining the impedance of the second antenna, and additional conductive material disposed on the first surface of the dielectric member to define the impedance of the first antenna.

11. In combination as set forth in claim 10, the additional conductive material being disposed on the first surface of the dielectric member opposite the conductive material on the second surface of the dielectric member.

12. In a combination as set forth in claim 11, the slots in the conductive material on the first surface of the dielectric member producing a conductive portion having, in the first direction, having a length defining the impedance of the second antenna, and the conductive portion on the first surface of the dielectric material extending from the additional conductive material on the first surface of the dielectric member.

13. In a combination as set forth in claim 12, the additional conductive material on the first surface of the dielectric material having a length defining the impedance of the first antenna.

14. In a combination as set forth in claim 13, the additional conductive material on the first surface of the dielectric member having a looped configuration to increase the length of the additional conductive material in a limited distance in the first direction on the first surface of the dielectric member.

15. In a combination as set forth in claim 12, the slots in the conductive material on the first surface of the dielectric member having portions extendiing from each other in a second direction transverse to the first direction to define the frequency of the second antenna.

16. In a combination as set forth in claim 14, the slots in the conductive material on the first surface of the dielectric member having portions extending from each other in a second direction transverse to the first direction to define the frequency of the second antenna, the slots in the conductive material on the first surface of the dielectric member having additional portions extending in the first direction at the ends of the slot portions extending in the second direction.

* * * * *